United States Patent [19]

Grassi

[11] 4,218,789

[45] Aug. 26, 1980

[54] BED STAND

[76] Inventor: Arturo Grassi, 2547 Drew Rd., Mississauga, Ontario, Canada

[21] Appl. No.: 13,174

[22] Filed: Feb. 21, 1979

[51] Int. Cl.[2] ..... A47C 19/00; A47B 19/04

[52] U.S. Cl. ..... 5/201; 5/295; 5/310

[58] Field of Search ..... 5/200 R, 201, 288, 294, 5/295, 296; 312/257 R, 257 SK, 263

[56] References Cited

U.S. PATENT DOCUMENTS

| | | | |
|---|---|---|---|
| 769,949 | 9/1904 | Kutz | 5/294 |
| 3,100,304 | 8/1963 | Brandlin et al. | 5/310 |
| 4,103,374 | 8/1978 | Knoke | 5/310 |
| 4,155,131 | 5/1979 | Harris | 5/201 |

*Primary Examiner*—Casmir A. Nunberg

*Attorney, Agent, or Firm*—Ridout & Maybee

[57] ABSTRACT

A dismountable bed stand is formed of side rails, and cross members comprising telescopic horizontal members terminating in vertical legs, the side rails and cross members interlocking rigidly without the use of fastenings and without obstructing the bed supporting surfaces on the side rails, while the whole stand may be fabricated from only three different metal sections.

4 Claims, 5 Drawing Figures

BED STAND

FIELD OF THE INVENTION

This invention relates to stands for beds of the kind comprising a frame equipped with castors for supporting a bed spring and optionally a headboard.

REVIEW OF THE PRIOR ART

Such stands are widely used to support bed springs especially where headboards are used and their main requirements in use are that they provide rigid but readily moveable support for a bedspring and headboard. At the same time they should be cheap in construction and preferably occupy the minimum of space prior to sale. Various folding and collapsible bed stands have been marketed, but they tend to be relatively complex in construction and relatively bulky even when folded or collapsed. Moreover, their structure often involves rivet heads or other projections in positions where they may damage the covering of a bed spring or prevent it from resting evenly on the stand.

SUMMARY OF THE INVENTION

The object of the present invention is to provide a dismountable bed stand which is of simple but strong and rigid construction, which occupies a minimum of space when dismounted which is readily adaptable to different sizes of bed, and which provides bed spring supporting surfaces which can be free of possibly harmful projections.

According to the invention, a bed stand comprises complementary side rails each having a longitudinal horizontal centre web, a longitudinal upturned outer flange and a longitudinal downturned inner flange, the web and one of the flanges of each rail being indepently bent at one end into a common plane perpendicular to the longitudinal extent of the rails to form a mounting flange for a headboard, at least two cross members spaced longitudinally of the rails and each comprising two telescopically nesting horizontal members of similar cross section and means releasably uniting the horizontal members in any one of a plurality of different telescoped relationships, each horizontal member having a downwardly extending leg, a castor at the foot of said leg, and outwardly extending shallow hook means, shelf means at a lower level than the upper extremity of said hook means, and outwardly facing vertical abutment means beneath said hook means and said ledge means, whereby said hook means of each horizontal member extend into but not through apertures in the webs of said side rails, and the inner flanges of said side rails rest against said abutment means, and the webs or the inner flanges of the side rails rest on said shelf means.

Preferably, the lower portions of the inner flanges of the side rails are turned horizontally outwardly, and lower hook members are provided beneath said upper hook members so as to enter apetures in said horizontally out-turned portions of said inner flanges.

Further features of the invention will become apparent from the following description of a preferred embodiment.

SHORT DESCRIPTION OF THE DRAWINGS

DESCRIPTION OF THE PREFERRED EMBODIMENT

Figure 1:
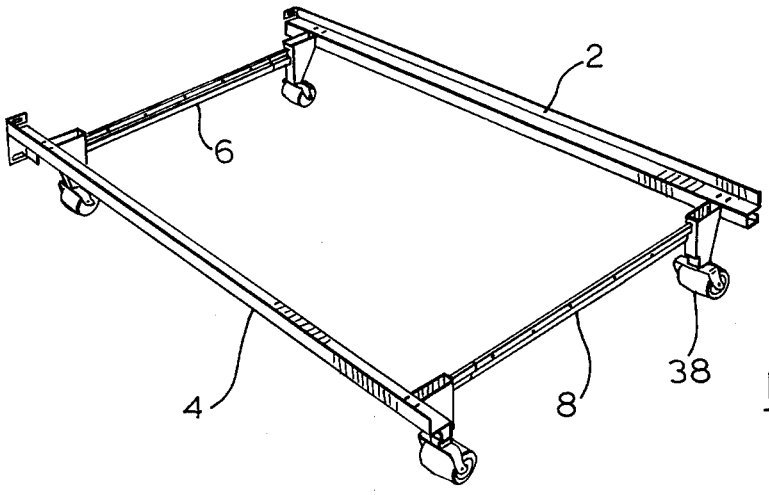
FIG. 1 is a perspective view of a bed frame in accordance with the invention.
Figure 4:
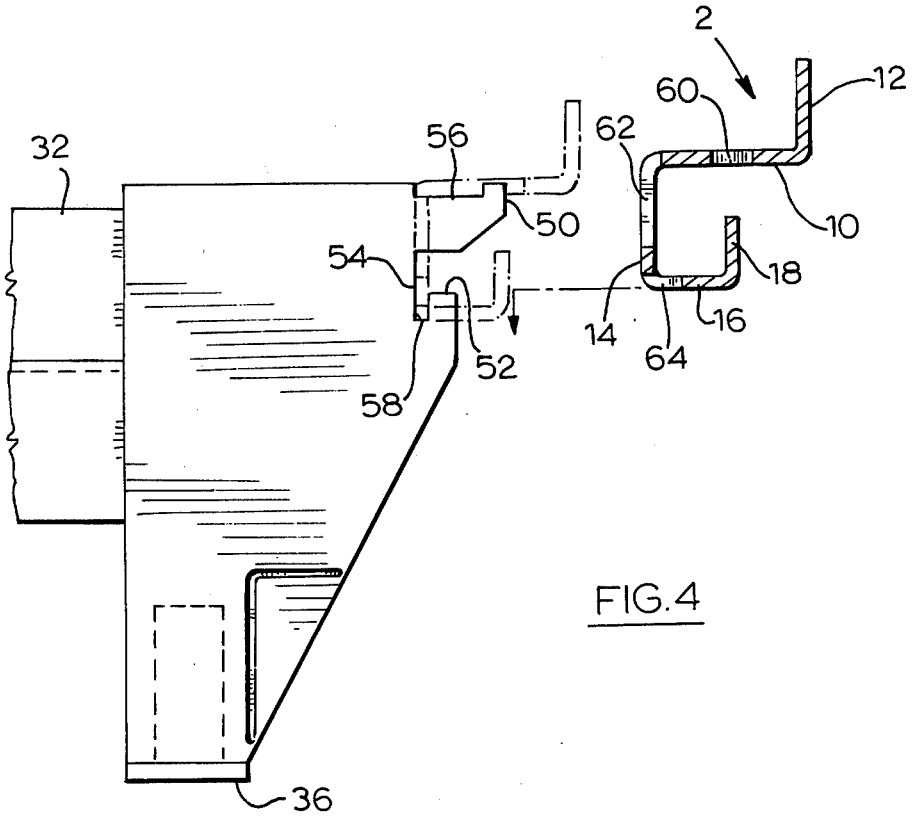
FIG. 4 is an end elevation corresponding to FIGS. 2 and 3.

Referring to FIGS. 1–5, a bed frame in accordance with the invention comprises two spaced longitudinal side rails 2, 4 and two spaced cross members 6, 8.

The side rails each comprise a central longitudinal horizontal web 10, an outer upturned flange 12, and a lower downturned flange 14, the distal portion of the downturned flange 14 being retroverted to provide successively out-turned and upturned portions 16, 18. At the one end of each rail, corresponding to the head end of a bed to be supported, the upturned flange 12 and the web 10 are separated and their end portions 22, 20 are each individually bent through 90° so as to lie in a common plane perpendicular to the length of the rail. The portions 20, 22 are provided with slots 24, 26 to receive bolts securing a headboard (not shown). A portion of the downturned flange 14 is cut away to provide clearance where a portion of this flange is bent downwardly with the web 10: the associated retroverted portion of this flange is cut away to provide clearance for a bolt passing through the slot 26. The downwardly bent portion of the downturned flange is welded to the remainder of the flange to increase the rigidity of the headboard support flange formed by the portions 20, 22. It will be appreciated that this support flange could alternatively be formed by bending portions of the web 10 and the downturned flange 14 into a common plane. If desired, similar footboard mounting flanges may be formed at the other ends of the rails.

The rails are supported by cross members 6, 8, usually two in number, although a third intermediate cross member may be desirable in some cases when supporting very large beds. The cross members each comprise two telescopically nesting horizontal members 30, 32 of similar cross section, the outer ends of the horizontal members incorporating legs formed by out-turned vertical channel members 34. The side wall of the channel members 34 are crimped together at their lower ends to form sleeves accommodating bushings 36 receiving the stems of rollers or castors 38. The horizontal members 30, 32 of each cross member, like the side rails 2, 4 have a horizontal web and upturned and downturned flanges, and may be secured together in a number of alternative partially telescoped relationships corresponding to different widths of bed by means of a screw 40 passing through a slot 42 in the member 30 and entering one of several threaded holes 44 tapped in the member 32. The slot 42 allows for fine adjustment of the spacing of the side rails 2, 4.

Figure 2:
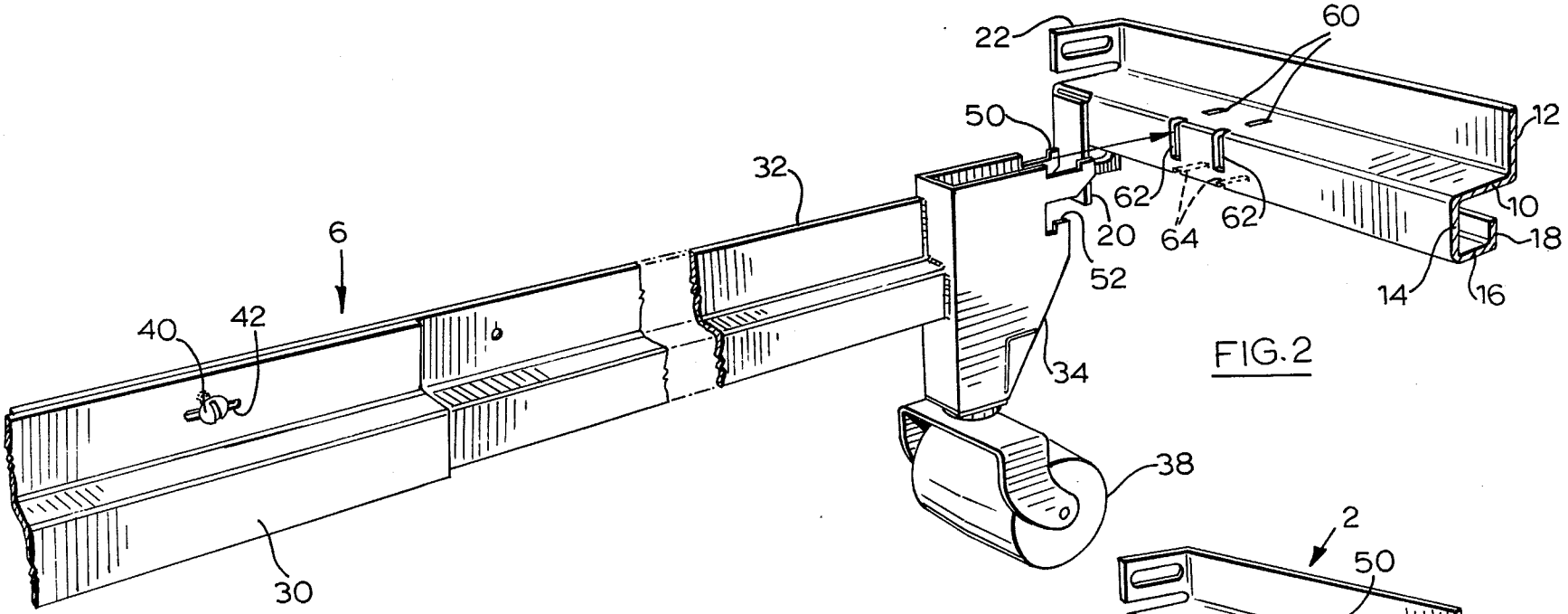
FIG. 2 is a detail on an enlarged scale, partially exploded to illustrate the assembly of parts of the bed frame of FIG. 1.
Figure 3:
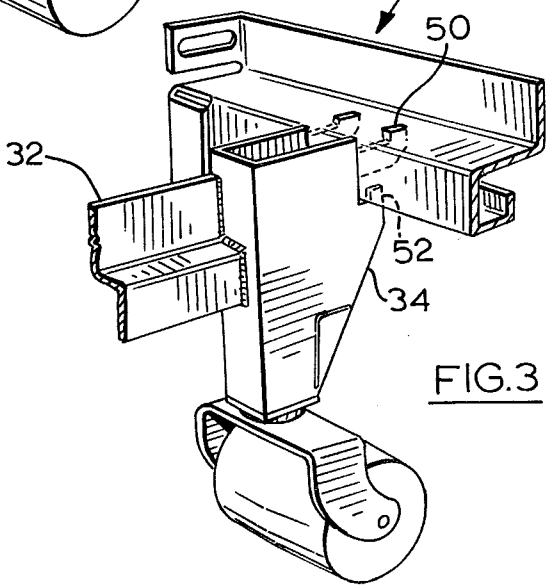
FIG. 3 is a detail corresponding to part of FIG. 7, but showing the parts fully assembled.
Figure 5:
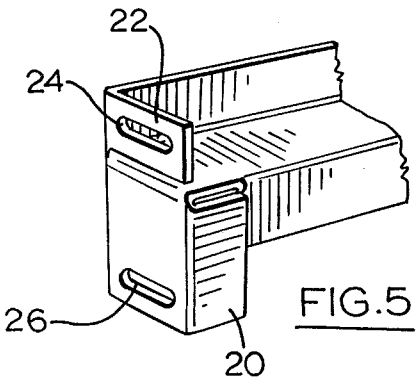
FIG. 5 is a detail showing one end of a side rail of the bed frame of the invention.

The outer edges of the channel members 34 are formed to provide upper and lower outwardly extending hooks 50 and 52, the hooks being spaced by vertical abutments 54 and the upper and lower hooks providing shelves 56, 58 between the hooks and the bodies of the channel members 34. As best shown in FIGS.2 and 3, the hooks of each channel member enter a system of slots 60, 62, 64 in one of the rails 2, 4, the upper hooks passing through the slots 62 in the flange 14 and entering but not passing through the slots 60 in the web 10. The lower hooks enter the slots 64 in the flange portion 16. The shelves 56 and/or 58 are at such a level as to limit the penetration of the upper hooks into the slots 60 and to bear the vertical load applied to the said rails, whilst cantilever loads are sustained by the upper hooks and the abutments 54. The lower hooks help to lock the rails in place and to sustain lateral forces on the legs as when the stand is being moved across a floor. Thus the stand when assembled and in use is rigid and well adapted to sustain the stesses applied to it both during use and movement of the bed which it supports.

When dismounted (simply by unhooking the rails from the cross members), the frame may be packed into a box of very small volume. By fully telescoping the horizontal members 30, 32, the cross members 6, 8 may be reduced to little more than half the width of the widest bed to be supported, and thus in most cases to less than half the length of the side rails; whilst the side rails will nest together to some extent; the whole assembly may therefore be accommodated in a box having a length equal to that of the side rails, the width equal to the height of the cross members and a depth of a couple of inches, with the side rails 2 and 4 nested and the cross members 6, 8 end to end. This compactness is a major advantage to retailers and wholesalers of beds, as is the adaptibility of the stand to different sizes of bed, since it avoids the necessity of giving over substantial amounts of valuable storage space to a relatively inexpensive item, and reduces inventory requirements.

The frame is also simple to manufacture and requires a minimum inventory of materials; apart from the castors 38 and the screws 40, which are mass produced items, only three different steel sections are required, one for the side rails 2, 4, one for the horizontal members 30, 32, and one for the channel members 34.

Because the upper hooks 50 do not pass through the slots 60, the inner surfaces of the flanges 12 and the upper surfaces of the webs 10 are smooth and unobstructed and will not damage the fabric covering of a bed spring supported by or being inserted into or removed from the frame.

What I claim is:

1. A bed stand comprising complementary side rails each having a longitudinal horizontal centre web, a longitudinal upturned outer flange and a longitudinal downturned inner flange, the web and one of the flanges of each rail being independently bent at one end into a common plane perpendicular to the longitudinal extend of the rails to form a mounting flange for a headboard, at least two cross members spaced longitudinally of the rails and each comprising two telescopically nesting horizontal members of similar cross section and means releasably uniting the horizontal members in any one of a plurality of different telescoped relationships, each horizontal member having a downwardly extending leg, a castor at the foot of said leg, and outwardly extending shallow hook means, shelf means at a lower level than the upper extremity of said hook means, and outwardly facing vertical abutment means beneath said hook means and said ledge means, whereby said hook means of each horizontal member extend into but not through apertures in the webs of said side rails, and the inner flanges of said side rails rest against said abutment means, and the webs or the inner flanges of the side rails rest on said shelf means.

2. A bed stand according to claim 1, wherein the lower portions of the inner flanges of the side rails are turned horizontally outwardly, and lower hook means are provided beneath said upper hook means so as to enter apertures in said horizontally out-turned portions of said inner flanges.

3. A bed stand according to claim 1 or 2, wherein each downwardly extending leg is outwardly facing vertical channel members, and the hook means, shelf means and abutments means are integrally formed in the side walls of the channel members.

4. A bed stand according to claim 3, wherein the side walls of the channel members are crimped together at their bottom ends to form sleeves, and the castors have stems entering bushings received in the sleeves.

* * * * *